US005421159A

United States Patent [19]

Stokes

[11] Patent Number: 5,421,159

[45] Date of Patent: Jun. 6, 1995

[54] BEVERAGE COOLER AND DISPENSER

[76] Inventor: Patrick F. Stokes, 2280 Stadium Blvd., Twin Falls, Id. 83301

[21] Appl. No.: 262,979

[22] Filed: Jun. 21, 1994

[51] Int. Cl.[6] ..... F25B 21/02

[52] U.S. Cl. ..... 62/3.64; 62/389; 62/394; 62/371; 62/457.9

[58] Field of Search ..... 62/3.64, 389, 394, 395, 62/397, 399, 457.1, 457.4, 371, 372

[56] References Cited

U.S. PATENT DOCUMENTS

| | | | |
|---|---|---|---|
| 1,634,457 | 7/1927 | Doughty | 62/389 |
| 2,805,556 | 9/1957 | Wang . | |
| 3,840,153 | 10/1974 | Devlin . | |
| 4,281,520 | 8/1981 | Norwood . | |
| 4,320,626 | 3/1982 | Donnelly | 62/3.64 |
| 4,413,481 | 11/1983 | Thomas . | |
| 4,640,101 | 2/1987 | Johnson . | |
| 4,681,611 | 7/1987 | Bohner . | |
| 4,884,721 | 12/1989 | Kirchler . | |
| 4,932,225 | 6/1990 | Bighouse . | |
| 4,961,324 | 10/1990 | Allan . | |
| 4,996,847 | 3/1991 | Zickler | 62/389 |
| 5,042,258 | 8/1991 | Sundhar . | |
| 5,063,754 | 11/1991 | Chou . | |
| 5,115,940 | 5/1992 | Friedman . | |
| 5,341,657 | 8/1994 | Fuller | 62/389 |

FOREIGN PATENT DOCUMENTS

| | | |
|---|---|---|
| 3412556 | 10/1985 | Germany . |
| 598067 | 2/1948 | United Kingdom . |

*Primary Examiner*—John M. Sollecito
*Attorney, Agent, or Firm*—Richard C. Litman

[57] ABSTRACT

A portable cooler for carrying and chilling a standard beverage container having a threaded cap. The container cap is removed, and the container is threaded into the cooler. The beverage container is inverted when the cooler is upright. The container neck threads into a socket which is in liquid communication with a faucet external to the cooler. A cooler cap threads to the body of the cooler, sealing a chilled chamber defined in the cooler, and retaining the beverage container therein. In an alternative embodiment, this cap cooperates with the beverage container, so that the container can be inserted upright, and used in that position. A handle is also optionally provided, so that the cooler can be handled in the manner of a pitcher. A refrigeration plant, which may be a miniature compression cycle type or a Peltier effect type, is housed inside the cooler. An electrical plug enables connection to a suitable electrical power source. In other alternative embodiments, the refrigeration plant either directly contacts a portion of the beverage container, or includes a chilled air circuit flowing across the beverage container. A strap constricts the cooler body about the beverage container. The cap includes an eye or the like for engaging a tether, so that the cooler may be easily carried. The cooler is plugged into suitable power, chills the beverage, and dispenses the beverage on demand by operating the integral faucet.

21 Claims, 2 Drawing Sheets

BEVERAGE COOLER AND DISPENSER

BACKGROUND OF THE INVENTION

1. Field of the Invention

The present invention relates to an apparatus for supporting and cooling a beverage container. The apparatus has a faucet for dispensing the beverage.

2. Description of the Prior Art

U.S. Pat. No. 5,042,258, issued to Shaam P. Sundhar on Aug. 27, 1991, discloses a container for storing and chilling a beverage. The beverage is held within a removable cup. The cup is in contact with the cooled side of an electrothermal cooler. A power cord enables connection to a supply of electrical power, and a switch is disposed within the power circuit.

A refrigerated beverage container having an articulated spout is seen in U.S. Pat. No. 4,961,324, issued to Barry S. Allan on Oct. 9, 1990. Chilling is provided by placing a refrigerant in close proximity to a bottle or the like held in the container.

U.S. Pat. No. 4,932,225, issued to Mary E. Bighouse on Jun. 12, 1990, is representative of beverage containers comprising an insulated compartment for holding a beverage container, and a built in, cooperating pouch for holding a refrigerant. The container disclosed herein includes a handle.

A food receptacle is held in an inverted position in a cooler disclosed in U.S. Pat. No. 4,884,721, issued to Manfred Kirchler on Dec. 5, 1989. The cooler has an internal cavity cooperating in configuration with a can. A Peltier effect cooler is provided to chill the can.

Another Peltier effect cooler is employed in U.S. Pat. No. 4,681,611, issued to Hal J. Bohner on Jul. 21, 1987. A wine bottle is maintained at a predetermined temperature. In alternative embodiments, the heated side of the Peltier device is cooled by an electrically powered fan and by ice.

In U.K. Pat. Document 598,067, dated Feb. 10, 1948, it is proposed to provide an auxiliary compartment within an otherwise standard refrigerator having a powered refrigeration plant. The auxiliary compartment is disclosed as cooperating in configuration with a bottle or similar beverage container.

German Pat. Document No. DE 3,412,556, dated October, 1985, discloses a portable cooler having an insulated chamber for holding a beverage container, and a powered refrigeration system. The refrigeration system may be of the compression cycle type, the Peltier effect type, or a liquid absorption type.

None of the above inventions and patents, taken either singly or in combination, is seen to describe the instant invention as claimed.

SUMMARY OF THE INVENTION

The present invention provides an apparatus for chilling the contents of a beverage container, and for dispensing these contents through a faucet formed integrally to the apparatus. A further feature of the apparatus is that the beverage container is opened and fastened to the apparatus, so that the beverage can be dispensed upon demand by operating the faucet. An electrically powered refrigeration plant chills the beverage.

The apparatus comprises a generally cylindrically shaped body, which has a central receptacle for receiving a beverage container originally provided with a threaded cap. The cap is removed and the container is inserted into the receptacle and threaded to cooperating threads formed at the bottom of the receptacle. A cap is threaded onto the body to help retain the container within the receptacle, and to complete enclosure of the container by the apparatus for insulation purposes. The cap has an eye for attaching a tether. This tether enables a person engaged in sports, such as hiking, to carry the apparatus without using his or her hands.

When the apparatus is held in a normal, upright orientation, the beverage container is inverted. Discharge of the beverage is prevented by a faucet formed in the body.

A refrigeration plant, which may be a miniature compressor, a Peltier effect thermoelectric device, or a miniature liquid absorption chiller, is contained within the body below the beverage container. The refrigeration plant includes, in one embodiment, a fan for circulating chilled air. An electrical cord extends exteriorly of the body.

Optionally, a strap is provided to constrict the cylindrical outer wall against the beverage container within. This is employed in those cases wherein a chilled heat exchange element extends along the cylindrical wall of the body, and is directly exposed to the beverage container. Good contact between the outer wall and the beverage container, caused by tightening the strap, promotes rapid chilling of the beverage.

In still another embodiment, the main body of the apparatus has a handle formed in the side, so that it can be lifted and manipulated in the manner of a cup or mug.

Another optional feature is provision in the cap for holding the beverage container in the normal position, rather than inverted. The cap is configured to cooperate with the tapered body of the beverage container, and also is provided with a second cap. This second cap can be removed to expose the neck of the beverage container. With the modified cap, liquid can be poured from the beverage container in the manner of a pitcher.

Accordingly, it is a principal object of the invention to provide a portable apparatus for holding and chilling a beverage container.

It is another object of the invention to provide an electrically powered refrigeration plant.

It is a further object of the invention to provide the apparatus with a faucet for dispensing the beverage on demand.

Still another object of the invention is to thread a beverage container to the novel apparatus, so that the cap of the container may be removed, and fluids therewithin are still retained.

An additional object of the invention is to provide a cap for retaining a beverage container within the novel apparatus, and for improving the insulation value of the container.

It is again an object of the invention to maintain good contact between chilled walls of the novel apparatus and a beverage container stored therein.

Yet another object of the invention is to transfer heat from the beverage can by providing a chilled air circuit within the novel apparatus.

A still further object of the invention is to enable a liquid to be poured from the top in the manner of a pitcher.

Yet an additional object is to provide a handle enabling the novel apparatus to be manipulated in the manner of a cup or mug.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figures 1, 1A:
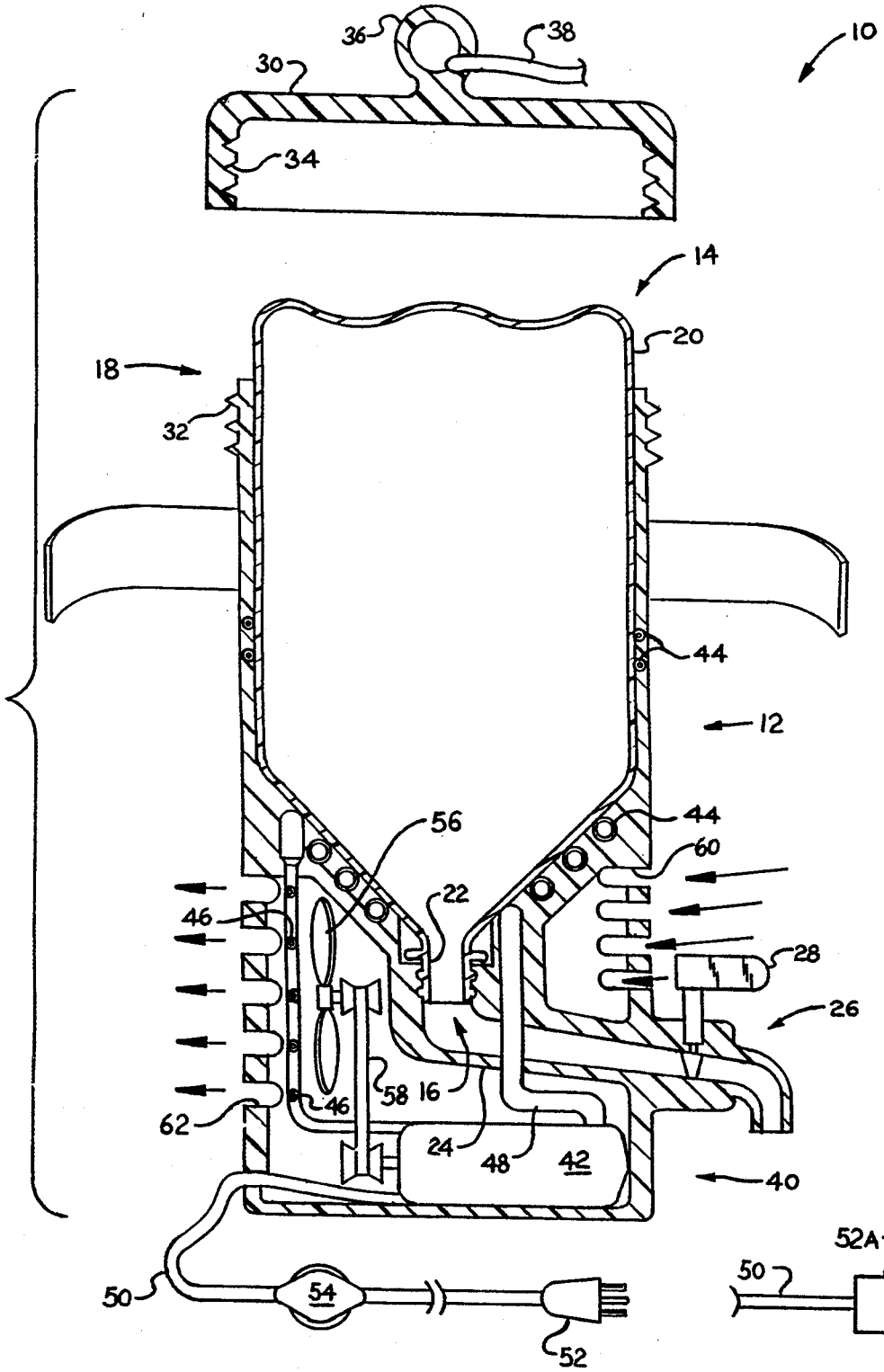
FIGS. 1 and 2 are diagrammatic, cross sectional, side elevational views of alternative embodiments of the invention, showing a beverage container disposed therein.
FIG. 1A is a detail view of an alternative embodiment electrical plug.

Turning now to FIG. 1 of the drawings, a first embodiment of the novel portable cooler 10 is seen to include a body 12 having a receptacle 14 defined therein. Receptacle 14 extends from a socket 16 located at the bottom of receptacle 14, in the orientation illustrated, to an open top end 18. A beverage container 20, of the type having a threaded neck 22, is seen as it will be carried in portable cooler 10. Beverage container 20 is inserted into receptacle 14 in an inverted position, after removal of the threaded cap (not shown). Beverage container 20 is received in socket 16, which socket 16 is sufficiently tightly fit to beverage container 20 so that no fluid contained therein escapes. Determining appropriate dimensions and configuration of socket 16 will be facilitated since commercial beverage containers have standardized neck threads and caps.

Socket 16 is in fluid communication with a conduit 24 extending from socket 16 to the exterior of body 12. A faucet 26 is arranged in series within conduit 24 to control dispensation of the beverage. Faucet 26 includes an operating handle 28 accessible to a user from the exterior of body 12.

Receptacle 12 is fully closed by attachment of a cap 30 thereto. Full closure of receptacle 12 signifies that receptacle 12 is sealed, so that the interior thereof, and hence beverage container 20, is prevented from fluid communication with the exterior of portable cooler 10. This improves the insulating ability of receptacle 12.

A suitable attachment arrangement includes threads 32 formed in the upper portion of body 12, and cooperating threads 34 formed in cap 30. In a preferred embodiment, cap 30 includes a projection, such as eye 36, for engaging a flexible tether 38.

Figure 2:
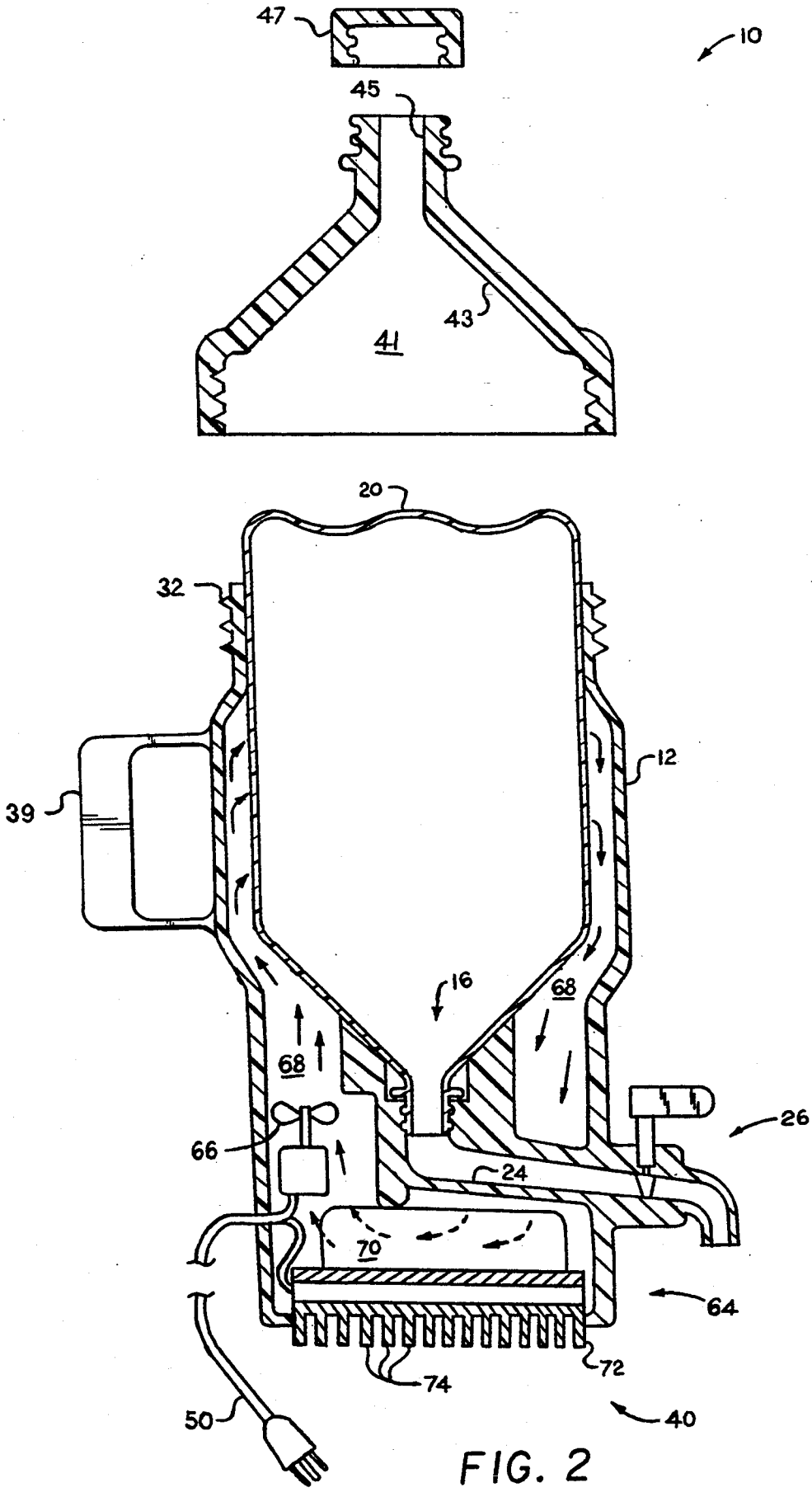

As seen in FIG. 2, an alternative embodiment of portable cooler 10 functions in the manner of a pitcher. A handle 39 is provided, so that cooler 10 may be lifted in one hand. Also, an alternative embodiment cap 41 enables a beverage container 20 to be inserted in the normal, upright orientation and secured in this position. Cap 41 includes a canted shoulder 43 which cooperates with the shoulder of beverage container 20. When cap 41 is tightened to threads 32, the neck of beverage container can protrude through cap neck 45. A second cap 47 closes cap neck 45. Beverage may thus be dispensed from the top or bottom of cooler 10.

Again referring to FIG. 1, portable cooler 10 also includes an electrically powered refrigeration plant 40 housed within body 12. Refrigeration plant 40 may be of any suitable type. One suitable type is a compression cycle type refrigeration plant, including compressor 42 and a refrigerant circuit including an evaporator coil 44 and a condensing coil 46, and suitable tubing 48 completing the circuit. Preferably, refrigeration plant 40 includes an electric cord 50 having a suitable plug 52. Plug 52 will be dimensioned and configured for compatibility with any suitable power source (not shown). It is contemplated that suitable power sources will include commercial AC power, such as 120 V, 60 Hz, available from a standard household electrical receptacle, and 12 V DC power. The latter is relatively conveniently available from the socket of an automotive cigarette lighter (not shown), and an appropriate plug 52A dimensioned and configured to cooperate with such a socket is shown in FIG. 1A. A switch 54 is optionally provided to control refrigeration plant 40.

Power taken from cord 50 operates both compressor 42 and a fan 56, driven by a belt and pulley arrangement 58 connected to the motor of compressor 42. Fan 56 provides necessary ventilation for dissipating heat generated in condensing coil 46. A representative heat dissipation circuit is illustrated, including air inlet slots 60 and air outlet slots 62. In this embodiment, heat is transferred from beverage container 20 by conduction. A heat exchange surface or heat transfer element is disposed within body 12, and makes direct contact with beverage container 20. In this embodiment, the heat transfer element is provided by a portion of evaporator coil 44. A strap 50 having a suitable clasp 52 of well known type for maintaining tightness is provided to constrict body 12 about beverage container 20.

Other arrangements of refrigeration plant 40 are possible. In the embodiment illustrated in FIG. 2, a Peltier effect thermoelectric device 64, such as employed in Bohner ('611) and Kirchler ('721), serves as the refrigeration source.

A second heat transfer scheme is also shown in FIG. 2. A fan 66 circulates air flowing in a sealed air passage 68 from the refrigeration source to beverage container 20. Thermoelectric device 64 includes internal fins 70, located on the cold side of device 64, which chill air flowing through air passage 68. As indicated by arrows in this Figure, air contacts beverage container 20, and returns to dissipate heat to fins 70.

On the hot side of device 64, fins 72 reject heat to the ambient atmosphere. Preferably, fins 72 collectively define a flat bottom surface 74, so that portable cooler 10 can be supported on a flat environmental surface (not shown).

It is to be understood that the present invention is not limited to the embodiments described above, but encompasses any and all embodiments within the scope of the following claims.

I claim:

1. A portable beverage container cooler for carrying and chilling a beverage container having a threaded neck, said cooler comprising:

a body defining a receptacle therein for containing the beverage container, said body having an open top end having threads;

a threaded socket located at the bottom of said receptacle, for threadedly receiving the beverage container;

means disposed within said body, defining a conduit in fluid communication with said socket and extending to the exterior of said body;

a faucet arranged in series within said conduit, controlling dispensation of the beverage, and including an operating handle accessible from the exterior of said body;

an electrically powered refrigeration plant housed within said body, further including an electrical cord having a plug, for connecting said refrigeration plant to a source of electrical power; and a cap having second threads cooperating with said threads of said top end, said cap fully closing said receptacle when installed, said cap having a diameter and further having means defining a threaded opening having a diameter of lesser magnitude than that of said cap diameter, and a second cap threadably attachable to said threaded opening.

2. The cooler according to claim 1, said cap further including a projection having means to engage a tether.

3. The cooler according to claim 1, further including at least one strap encircling said body, for constricting said body about the beverage container, said strap having clasp means for maintaining said strap tight.

4. The cooler according to claim 1, said refrigeration plant comprising a refrigerant compressor and a refrigerant circuit comprising an evaporator coil and a condensing coil.

5. The cooler according to claim 1, said refrigeration plant comprising a Peltier effect thermoelectric device.

6. The cooler according to claim 1, wherein said refrigeration plant includes a chilled heat transfer element contacting the beverage container.

7. The cooler according to claim 1, wherein said plug is dimensioned and configured to cooperate with a standard household electrical receptacle.

8. The cooler according to claim 1, wherein said plug is dimensioned and configured to cooperate with an automotive cigarette lighter receptacle.

9. The cooler according to claim 1, further including a handle attached to said body.

10. A portable beverage container cooler for carrying and chilling a beverage container having a threaded neck, said cooler comprising:

a body defining a receptacle therein for containing the beverage container, said body having an open top end including threads, and a handle attached to said body;

said cooler further including a cap having second threads cooperating with said threads of said top end, said cap fully closing said receptacle when installed, said cap having a diameter and further having means defining a threaded opening having a diameter of lesser magnitude than that of said cap diameter, and a second cap threadably attachable to said threaded opening;

a threaded socket located at the bottom of said receptacle, for threadedly receiving the beverage container;

means disposed within said body, defining a conduit in fluid communication with said socket and extending to the exterior of said body;

a faucet arranged in series within said conduit, controlling dispensation of the beverage, and including an operating handle accessible from the exterior of said body; and an electrically powered refrigeration plant housed within said body including a chilled heat transfer element contacting the beverage container, further including an electrical cord having a plug, for connecting said refrigeration plant to a source of electrical power.

11. The cooler according to claim 10, said cooler further comprising a tether, and said cap further including a projection having means to engage said tether.

12. The cooler according to claim 10, further including at least one strap encircling said body, for constricting said body about the beverage container, said strap having clasp means for maintaining said strap tight.

13. The cooler according to claim 10, said refrigeration plant comprising a refrigerant compressor and a refrigerant circuit comprising an evaporator coil and a condensing coil.

14. The cooler according to claim 13, wherein said refrigeration plant includes a fan circulating chilled air, and said body includes means defining an air passage conducting said chilled air from said refrigeration plant to the beverage container.

15. The cooler according to claim 10, said refrigeration plant comprising a Peltier effect thermoelectric device.

16. The cooler according to claim 10, wherein said plug is dimensioned and configured to cooperate with a standard household electrical receptacle.

17. The cooler according to claim 10, wherein said plug is dimensioned and configured to cooperate with an automotive cigarette lighter receptacle.

18. A portable beverage container cooler for carrying and chilling a beverage container having a threaded neck, said cooler comprising:

a body defining a receptacle therein for containing the beverage container, said body having an open top end, said body includes means defining an air passage;

a threaded socket located at the bottom of said receptacle, for threadedly receiving the beverage container;

means disposed within said body, defining a conduit in fluid communication with said socket and extending to the exterior of said body;

a faucet arranged in series within said conduit, controlling dispensation of the beverage, and including an operating handle accessible from the exterior of said body; and an electrically powered refrigeration plant housed within said body, further including an electrical cord having a plug, for connecting said refrigeration plant to a source of electrical power, and a fan for circulating chilled air from said refrigeration plant to the beverage container through said air passage.

19. The cooler according to claim 18, wherein said refrigeration plant includes a Peltier effect thermoelectric device.

20. The cooler according to claim 18, wherein said plug is dimensioned and configured to cooperate with an automotive cigarette lighter receptacle.

21. The cooler according to claim 18, further including a handle attached to said body.

* * * * *